US006688373B2

(12) United States Patent
Corey et al.

(10) Patent No.: US 6,688,373 B2
(45) Date of Patent: Feb. 10, 2004

(54) ARCHITECTURAL COVERING FOR WINDOWS

(75) Inventors: John A. Corey, Melrose, NY (US); Vinny Grosso, Albany, NY (US); Arthur T. Karis, Stephentown, NY (US); Rich Watkins, Lake Luzerne, NY (US); Raymond E. Randall, Jr., New Hartford, NY (US)

(73) Assignee: Comfortex Corporation, Watervliet, NY (US)

( * ) Notice: Subject to any disclaimer, the term of this patent is extended or adjusted under 35 U.S.C. 154(b) by 0 days.

(21) Appl. No.: 09/834,083

(22) Filed: Apr. 11, 2001

(65) Prior Publication Data

US 2001/0054490 A1 Dec. 27, 2001

Related U.S. Application Data

(60) Provisional application No. 60/196,726, filed on Apr. 13, 2000, and provisional application No. 60/272,180, filed on Feb. 28, 2001.

(51) Int. Cl.[7] ..... E06B 3/08

(52) U.S. Cl. ..... 160/236; 160/89; 160/84.05; 160/900

(58) Field of Search ..... 160/236, 84.06, 160/84.05, 168.1 R, 168.1 V, 176.1 R, 176.1 V, 89; 156/218, 626, 308.2

(56) References Cited

U.S. PATENT DOCUMENTS

| | | | | |
|---|---|---|---|---|
| 1,526,172 A | * | 2/1925 | Near | |
| 1,851,782 A | * | 3/1932 | Sugiura | |
| 2,169,873 A | * | 8/1939 | Clark, Jr. | |
| 2,170,938 A | * | 8/1939 | Carreras et al. | 160/178.1 R |
| 2,326,454 A | | 8/1943 | Gentile | |
| 3,844,330 A | | 10/1974 | Hyman | 160/166 A |
| 3,851,699 A | | 12/1974 | Shapiro | |
| 4,930,562 A | | 6/1990 | Goodman | |
| 5,603,369 A | * | 2/1997 | Colson et al. | |

(List continued on next page.)

FOREIGN PATENT DOCUMENTS

| | | | |
|---|---|---|---|
| CA | 2090046 B1 | | 8/1994 |
| CH | 342360 | * | 12/1959 |
| DE | 837171 B1 | | 4/1952 |
| DK | 69549 | * | 6/1949 |
| NO | 67223 | * | 9/1949 |

*Primary Examiner*—Blair M. Johnson
(74) *Attorney, Agent, or Firm*—Rader, Fishman & Grauer PLLC

(57) ABSTRACT

An architectural covering, such as a blind, for use primarily over windows and doorways, includes of a plurality of separate composite vanes made of an opaque rigid material and a sheer material, if desired. Each composite vane can be manufactured as a flat, rollable laminated assembly of strips and joined or bonded at least substantially on a line along the length of the strip and substantially along one edge of one strip. Several different embodiments of the composite vane are disclosed. In one embodiment, the composite vane comprises a generally flat, unexpanded opaque material with individual pieces of sheer material attached to an edge of the vane. In another embodiment, a laminated composite vane comprises a pair of strips with the transverse width of one strip greater than the other strip to form a torque tube when edge-joining the strips. In yet another embodiment, the laminated composite vane includes a pair of strips of substantially equal width with a resilient insert strip having a non-flat cross section inserted into the torque tube. The resilient insert strip can assume a flat transverse form, but return elastically to the predetermined cross-sectional shape when removed from the roll or be inserted after each vane is cut to its final length. Any combination of the above-mentioned embodiments is possible to connect single or double sheets of sheer material to the edges of the vanes while enabling the vanes to be oriented vertically or horizontally.

20 Claims, 11 Drawing Sheets

U.S. PATENT DOCUMENTS

| | | | | |
|---|---|---|---|---|
| 5,638,880 | A | 6/1997 | Colson et al. | 160/84.01 |
| 5,664,613 | A | 9/1997 | Jelic | |
| 5,749,404 | A | 5/1998 | Colson | 166/84.04 |
| 5,797,442 | A | 8/1998 | Colson et al. | 166/236 |
| 5,876,545 | A | 3/1999 | Swiszcz et al. | |
| 5,960,850 | A | 10/1999 | Colson et al. | 160/236 |
| 6,024,819 | A | 2/2000 | Corey | |
| 6,170,552 | B1 | 1/2001 | Colson et al. | 160/168.1 V |
| 6,510,806 | B1 | 1/2003 | Krieck | |

* cited by examiner

ARCHITECTURAL COVERING FOR WINDOWS

CROSS NOTING TO RELATED APPLICATIONS

This application claims the benefit of provisional patent Application Serial No. 60/196,726, filed on Apr. 13, 2000, and provisional patent Application Serial No. 60/272,180, filed on Feb. 28, 2001.

BACKGROUND OF THE INVENTION

1. Field of the Invention

This invention relates to improved construction of an architectural covering for windows, and in particular to a vertical or horizontal blind with individual, narrow strips of sheer material and a vane having a strip element disposed therein.

2. Description of the Related Art

In many window or see-through door applications, it is desirable to control the amount of light admitted through the window or see-through door. For instance on bright sunny days in warm climates, the sun is too strong (and too hot) for comfortable working in offices, as well as being damaging to interior furnishings that may fade or become brittle. Typically, blinds are fitted, consisting of multiple slats of opaque material that can be individually rotated, in a coordinated manner, to block all or part of the light. When such slats are arrayed horizontally, the assembly is commonly called a "venetian" blind.

In large windows or doors, venetian blinds are difficult to raise completely, when needed for unobstructed viewing or to clean the glass behind. So, often a variant called "vertical blinds" is fitted, in which rotatable slats are hung vertically from their ends on a traverse mechanism with individual, coordinated rotating hangers. Vertical blinds have been most often used in commercial settings, where large windows are more common. In residential use, only patio doors and the like have commonly used these blinds.

Known vertical blinds commonly comprise elongated strips or slats of opaque material suspended vertically from an overhead traverse mechanism provided with individual, rotatable hangers. Some vertical blind products combine a sheer fabric with the rotatable, opaque vertical slats to provide diffusion of the light entering between the opaque slats, as well as adding privacy as a result of reduction in the clarity of view from the bright exterior into the interior of the building.

Examples of such combination vertical blinds are disclosed in U.S. Pat. No. 3,844,334 to Hyman and U.S. Pat. No. 5,638,880 to Colson et al. In Colson et al., the slats are integrated as stiffened fabric vanes permanently attached onto the expanse of covering sheer fabric. Tachikawa Company of Japan offers a vertical blind in which alternating vanes are sheer and opaque, but the hangers for the sheer vanes lack driven rotators, so that the sheer vanes tend to remain in planar alignment between adjacent opaque vanes when the latter are rotated toward their view-through position. This product lacks the aesthetically-preferred appearance of a continuous, billowed curtain, and gapping between the sheers and opaques is a problem because the sheers are free to rotate, though not forced to do so.

Even in smaller windows, where horizontal shading is practical, there has been a move toward light-diffusing systems. Translucent cellular shades and fabric venetian blinds have been devised using light-filtering materials to give light-diffusing properties to the window coverings. Of these, the fabric venetian blinds also present a sheer fabric covering that partly obscures the interior of a room from outside view, even when the major light-control elements are positioned for open view-through. This is a desirable feature for vertical blinds, too, and has been implemented in two ways: layering of a sheer curtain over a conventional rigid-vane vertical blind; and integrating the slats as stiffened fabric vanes permanently attached onto the expanse of the covering sheer.

The inventors of the present invention have recognized that a disadvantage of known opaque-with-sheer vertical blinds is that they use a large expanse of fragile sheer fabric to cover the entire opening. This requires a high degree of costly precision in fabric quality, handling, and cleaning to assure the delicate fabric remains free of visible flaws and damage throughout. The manufacturing equipment must be very large and costly (typically handling goods 90 to 150 inches in width), adding immensely to the final product cost and limiting the variety of colors and styles that can be produced. Waste in fabricating finished shades from such goods to fit various window sizes is significant (typically over 20% of raw goods, even with carefully optimized fitting). Installation, and even shipping, is extremely awkward with such large delicate sheers, and washing is almost impossible. Should one spot on the product become soiled or damaged, the entire product becomes waste. Still, consumers readily pay this price to achieve the soft, light-diffusing privacy and light control provided by such sheers with rotatable vanes.

SUMMARY OF THE INVENTION

In one embodiment of the invention, the architectural covering comprises a vertical or horizontal blind including an opaque strip or vane and a covering sheer strip, wherein the vanes are not expanded by any bowing or resilience. Each vane comprises an integrated composite of a relatively opaque portion and a laterally adjacent and relatively translucent portion having an upper end that is remote from its associated relatively opaque portion. The upper end is adapted to be secured to at least one of either the next adjacent hanger (typically carrying the next adjacent vane) or the free end of the relatively opaque portion of the next adjacent vane when such vane is installed in a window opening. This embodiment of the invention is especially useful for smaller windows and very flaccid sheers if the opaque strips are relatively heavy and stiff.

In another embodiment of the invention, an improved blind is disclosed for use primarily over vertically-glazed windows and doorways comprising a plurality of separate composite strips, wherein each composite strip is manufactured as a flat, rollable overlay assembly of strips. At least one of the strips could be transversely elastically bowed and attached along its free edge to another strip, forming a substantially rigid closed-perimeter element with an expanded cross-section for torsional and flexural strength.

The expanding of the section may be accomplished in a variety of ways. One way is by providing one strip having a transverse width greater than that of the one to which it joins, and by making the former strip resilient to bowing so as to create tension in the latter strip when the two are joined edge-to-edge after removal from a rolled to a straight condition. Another way the bowing may be accomplished is by inserting a separate resilient folded strip into the closed-perimeter element formed by edge-joining of strips in the basic composite, whereby the resilient strip is fitted into and through a substantial part of the length of the composite, after the composite is removed from a roll into a straight condition. Yet another way the bowing may be accomplished is by providing a resilient insert having a "V", "C" or "S section form (or the like) that may be inserted into the closed-perimeter composite before rolling, whereby the resilient insert can assume a flat transverse form, but return elastically to the V, C, or S (or the like) when removed from the roll.

In one embodiment, each composite strip comprises at least a sheer or translucent portion and a relatively opaque portion; the two portions overlying in part, and joined or bonded at least substantially on a line along the length of the strip and substantially along one edge of one strip (typically the opaque). In another embodiment, each composite strip does not include the sheer translucent portion. As manufactured, strip portions are flat and overlaid, enabling rolling up of the composite. At final fabrication into a shade, cut lengths corresponding to the height (or width) of the window are assembled by bowing at least one strip (typically the opaque) and, if of the unequal transverse width type, adhering the previously unattached edge of that strip to the other strip, forming the bowed closed-perimeter section; and if of the insert type, either inserting the resilient strip or merely allowing the previously inserted element to re-assume its natural transverse form. The bowed strips are thereby made both torsionally-stiff and rigid against bending, although the resilient nature of the stiffening will allow bending past the limit of their elastic resistance, without permanent damage.

If used in a vertical orientation, the expanded composite strips are then hung by their top ends from an overhead rail with individual hangers (as commonly used for prior art vertical strip blinds), with attachment made to either the sheer, if present, or the opaque portions of the strips. In the preferred embodiment of the invention, the sheer portion is folded back across the opaque portion and then attached to the adjacent hanger, causing the sheer to span between adjacent opaque portions and giving the illusion of a continuous sheer curtain combined with light-controlling vanes.

If used in a horizontal application, the expanded composite strips may be assembled into conventional venetian blind ladder cord and actuator structures, with the sheer portions, if present, joined along the free edge, in either continuous or periodic points, to the adjacent strip; or they may be joined one to another with the sheers in tension between them, to provide alternate means of support and actuation (vane rotation).

It should be noted that the expanded element portion of the composite may also be made without an attached sheer, providing a lightweight, insulating, and optionally, light-diffusing replacement for conventional rigid-vane opaque vertical blinds or venetian blinds. It should also be noted that the opaque portion of each vane could be constructed of a single piece of material folded on itself, rather than from separate strips with two bond lines.

As described above, the present invention employs a novel strip construction that can provide the appearance and functions of the continuous sheer with rotatable vanes, but in a manner which requires far smaller and simpler manufacturing equipment; packages and installs much more easily; and is readily handled for cleaning or repair at minimal cost. The embodiments without sheer elements provide direct replacement for conventional solid vanes in horizontal venetians or vertical blinds, but with much lower mass and stowed bulk. The separate insert embodiments, both with and without sheers, further provide for convenient and inexpensive options in light blocking features, as the inserts can be, for instance, clear, milky, smoky, reflective, polarized, or opaque, without substantially altering the surface coloration or textures of the product, unlike conventional vertical or venetian blinds.

DESCRIPTION OF THE PREFERRED EMBODIMENT

Figure 1:
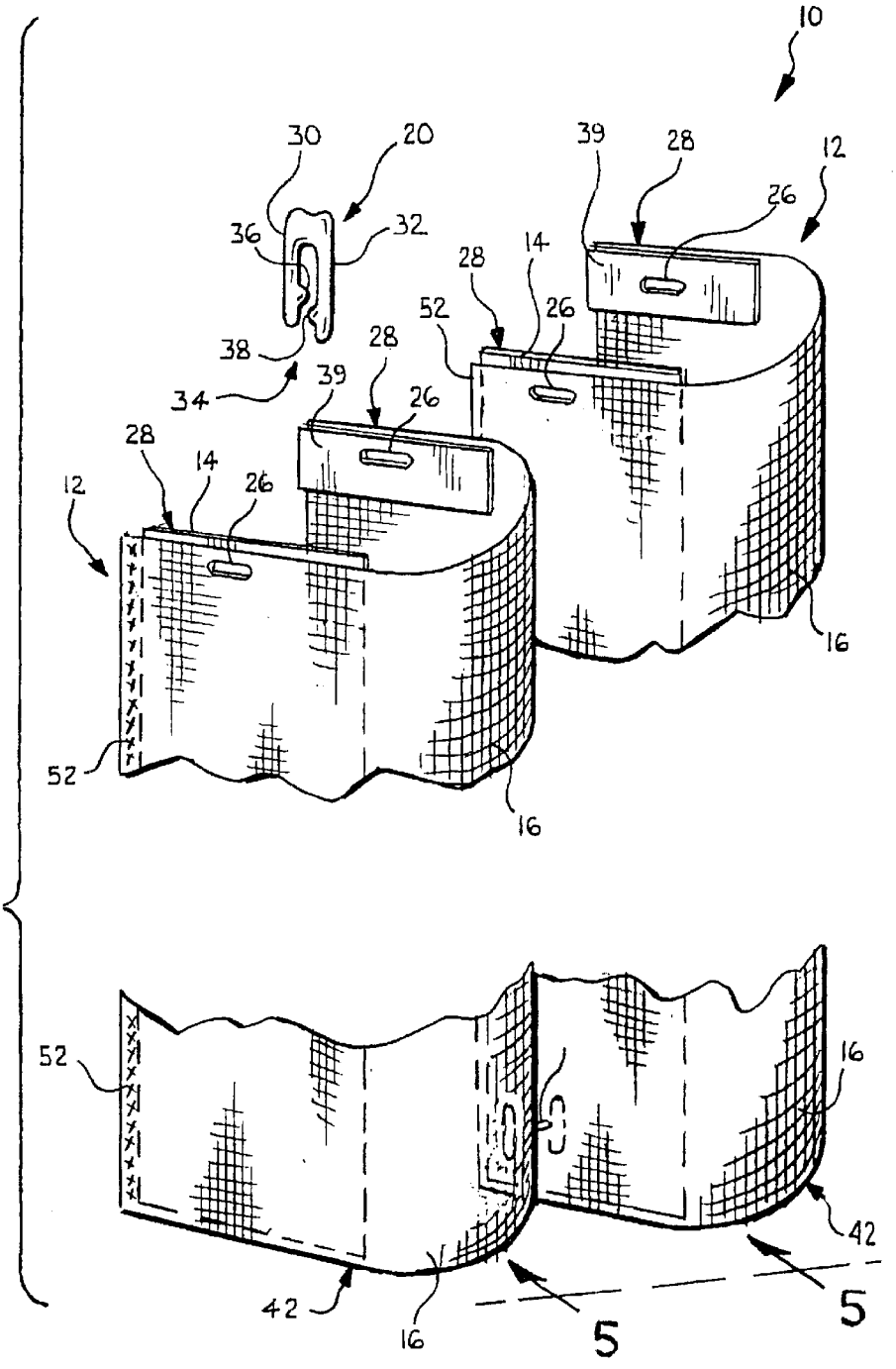
FIG. 1 is a cutaway perspective view of an architectural covering, such as a blind, for a window in accordance with the invention in which an upper end of the blind is suspended from a conventional hanger and a lower end is secured by means of a conventional plastic tack.
Figure 2:
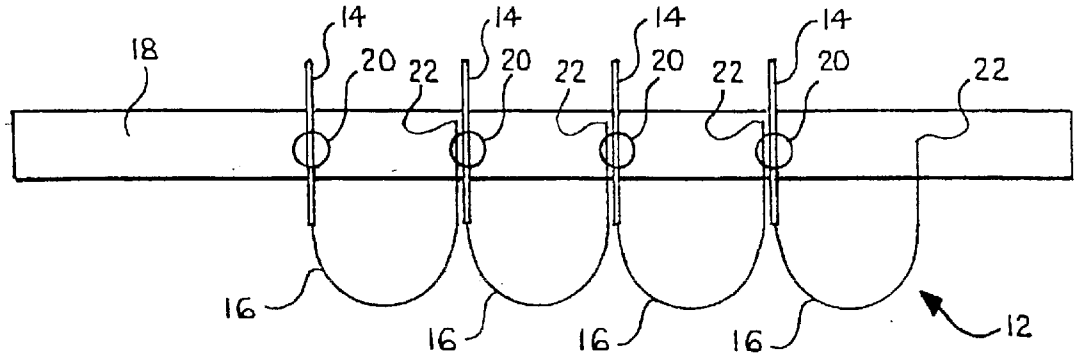
FIG. 2 illustrates a top plan view of a conventional traverse type head rail provided with rotatable hangers with an opaque strip or slat suspended from each hanger.

Referring now to FIGS. 1 and 2, the architectural device 10 of the invention will now be described. For purposes of the invention, the architectural device will normally be referred to as a window blind 10. However, it will be appreciated that the architectural device 10 could be used for other purposes, such as on doors or to otherwise furnish the interior of dwellings.

The window blind 10 includes one or more vanes 12, each vane 12 comprising an integrated composite of a relatively opaque portion or strip 14 (shown thicker) forming a light-controlling element, and a laterally adjacent and relatively translucent sheer portion or strip 16 (shown thinner) forming a light-diffusing element. The vane 12 can be formed by differential weaving or knitting; or by joining of dissimilar strips of opaque and sheer material by gluing, welding, stitching, or other attaching means along their common edge, whether abutted or lapped, as described below. Alternately, the sheer portion 16 can extend across the full width of the vane 12 with the opaque portion 14 laminated or painted (applied in fluid form) onto a portion of the sheer portion 16.

In an alternate embodiment of the vanes 12, the sheer portion 16 can be wider than the opaque portion 14 so that the sheer portion 16 can be folded over on itself for a portion of its width and joined to itself to form a tubular portion into which an opaque element can be fitted, as described below.

The window blind 10 broadly includes a conventional traverse type head rail 18 that could be suspended from a wall or ceiling (not shown) adjacent to a window opening (not shown). The head rail 18 is provided with conventional rotatable hangers 20 (schematically shown as circles in FIG. 1), with the opaque portion 14 suspended from each hanger 20. A free or distal edge 22 of each sheer portion 16 is schematically shown as secured to the hanger 20 for the next adjacent composite vane 12. The billowing of each sheer portion 16 between its edge 22 creates an illusion of a continuous curtain-like sheet of sheer material.

The window blind 10 includes a hole 26 near an upper end 28 of the vane 12 for mounting to the conventional hanger 20. Typically, the hanger 20 includes opposed, staggered sides 30, 32 at a lower end 34 of the hanger 20. One side 30 includes an outwardly extending projection 36 and the other side 32 includes a vertically offset outwardly extending projection 38. To mount the vertical blind 10 to the hanger 20, the upper end 28 of the vane 12 is passed between the opposed, staggered sides 30, 32 of the lower end 34 of the hanger 20. As a result, the hole 26 of the vane 12 is captured by the staggered overlap formed by the projections 36, 38 of the two sides 30, 32 of the hanger 20. The upper end 28 of each vane 12 may include a stiffening member 39 for providing structural reinforcement and increased wear resistance where the sheer portion 16 engages the staggered overlap of the two sides 30, 32 of the hanger 20. The stiffening member 39 may be in the form of a strip of adhesive-backed stiff polyester film, for example, MYLAR®, commercially available from the DuPont Corporation.

Figure 5:
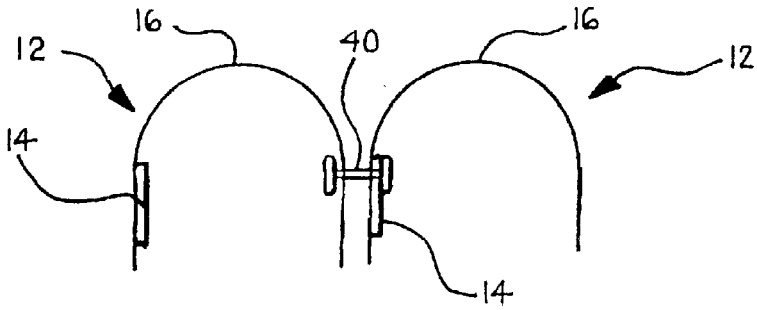
FIG. 5 is a cross sectional view taken along the line 5—5 of FIG. 1.

As best shown in FIGS. 1 and 5, the lower ends 42 of adjacent vanes 12 can be loosely secured to each other by means such as a conventional plastic tack 40 which is pushed through the fabric and retained by the flexible, T-shaped end configuration of the tack 40. This type of tack is commonly used to retain tags on fabric merchandise, such as clothing. One end of the opaque portion 14 and the sheer portion 16 may be joined to form a joint 52 along the vertical length of the vane 12.

The construction of each vane 12 can take several forms, all consistent with the various embodiments of the invention. The vane 12 can be manufactured by differential weaving or knitting of the two zones of differing light transmission ability; by joining of dissimilar strips of opaque and sheer materials by glue, welding, stitching or other attachment means along their common edge, whether abutted or lapped; or the sheer can extend across the full width of the composite, with the opaque portion achieved by lamination or application of paint to a portion of the sheer. Still another alternative is to use a sheer strip having greater width than the final composite strip, so that the sheer is folded over upon itself to form a tubular portion into which an opaque element can be inserted.

Figure 3:
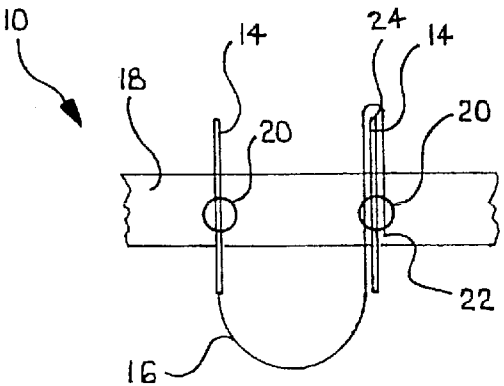
FIGS. 3 and 4 show alternative means for securing the free or distal end of the sheer portion of a composite vane to the hanger of the adjacent composite vane.
Figure 4:
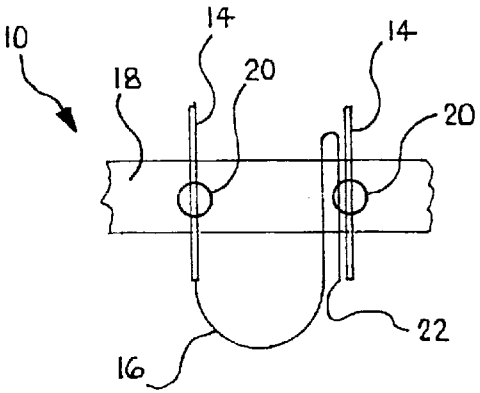

As best seen in FIGS. 1 and 2, one aspect of the invention is that the sheer portion 16 is made of individual, narrow strips of sheer material, rather than one sheer for the entire vertical blind as in conventional blinds. It will be appreciated that the free or distal edge 22 of each sheer portion 16 can be secured to the next adjacent opaque portion 14 in a variety of different ways. For example, FIGS. 3 and 4 show alternative means for securing the free or distal edge 22 of the sheer portion 16 of the vane 12 to the hanger 20 for the adjacent vane 12. In FIG. 3, the free edge 22 is looped around one end 24 of the opaque portion 14 of the adjacent vane 12, and doubled back thereon for securing to the hanger 20 for that vane. In FIG. 4, the free edge 22 is doubled back on itself before being secured to the adjacent hanger 20.

In the illustrated embodiment of FIG. 1, a problem may occur because the vertical blind 10 is constructed from uniformly thin, flexible vanes 12 that can be rolled during manufacture and for shipment. Unfortunately, the same properties give the vanes 12 a tendency to curl when hanging and to flex torsionally in response to forces from adjacent elements, rather than following the orientation imposed by the hangers 20 at the head rail 18. This curling and flexing behavior may prevent full closure of the vertical blind 10 in the light-blocking position.

To correct this potential problem, the present invention is also directed in general to a novel vane construction that provides for a closed-perimeter torque tube. The torque tube may include an elastic, resilient expansion means that holds the vane open for straightness and torsional stiffness, but allows flat collapse of the vane for roll-up and transport.

Figure 6:
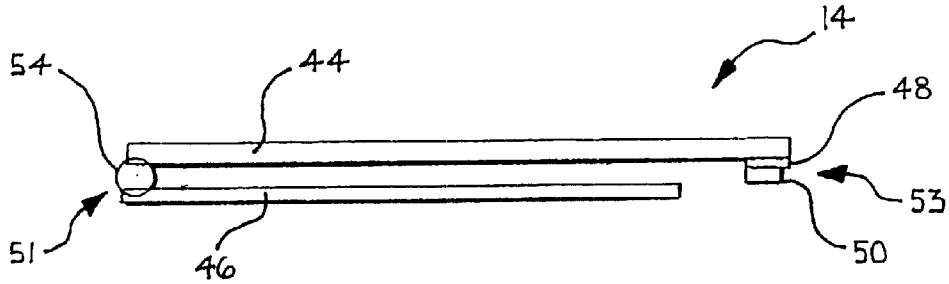
FIG. 6 shows a rollable laminate with an adhesive strip for a blind with an expanded vane according to a first embodiment of the invention.
Figure 7:
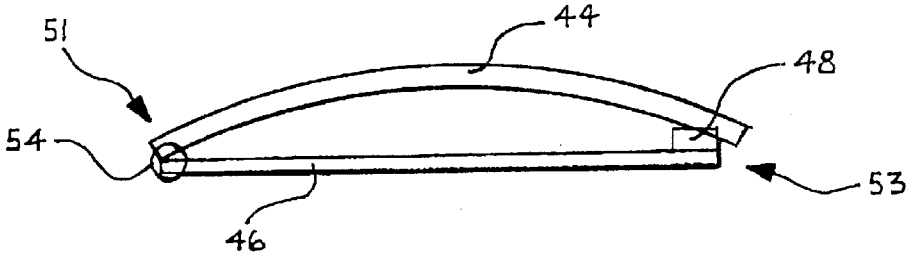
FIG. 7 shows the assembled expanded vane of FIG. 6.

FIGS. 6 and 7 show one embodiment of a laminated opaque portion 14 for use in the composite vane 12 of the invention. As shown in FIG. 6, a first resilient strip 44 is laminated along one edge or free end 51 to a second narrower strip 46. The first and second strips 44, 46 can be made of any suitable flexible material that is light enough to be suited for use in a window covering and which does not break down under temperatures known to be prevalent in windows exposed to direct sunlight. The first and second strips 44, 46 may have a different thickness. For example, the first strip 44 may have a greater thickness than the second strip 46. Suitable materials would include aluminum, plastic, fabric, or the like.

Attachments means, such as pressure-sensitive adhesive 48 with a temporary removable cover 50 is provided along the other edge or free end 53 of either the first resilient strip 44 or the second narrower strip 46. The pressure-sensitive adhesive 48 can be of the type well known in the art. The first ends of the first resilient strip 44 and the second narrower strip 46 are joined together by gluing, welding, stitching, or other attaching means to form a joint 54. To fabricate the laminated opaque portion 14 for use in the composite vane 12, the first resilient strip 44 is bowed and attached to the second narrower strip 46 along their free edges or ends 53 to draw the second narrower strip 46 tight across its width. As shown in FIG. 7, the interior of the first and second strips 44, 46 of the opaque portion 14 of the composite vane 12 forms a torque tube.

Figure 8:
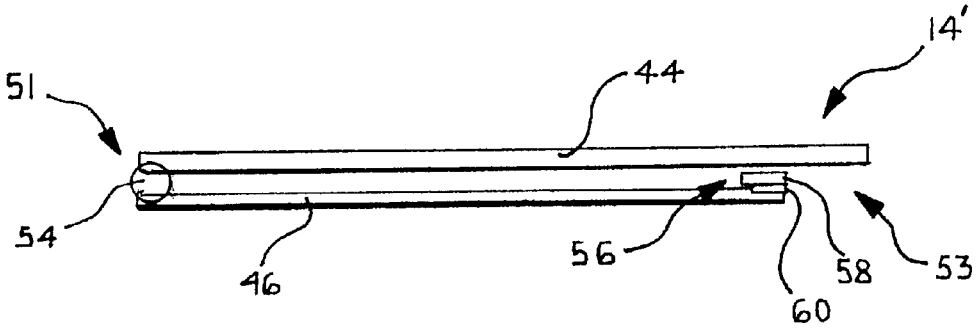
FIG. 8 shows a rollable laminate with a receiving pocket for the blind with the expanded vane according to an alternate embodiment of the invention.
Figure 9:
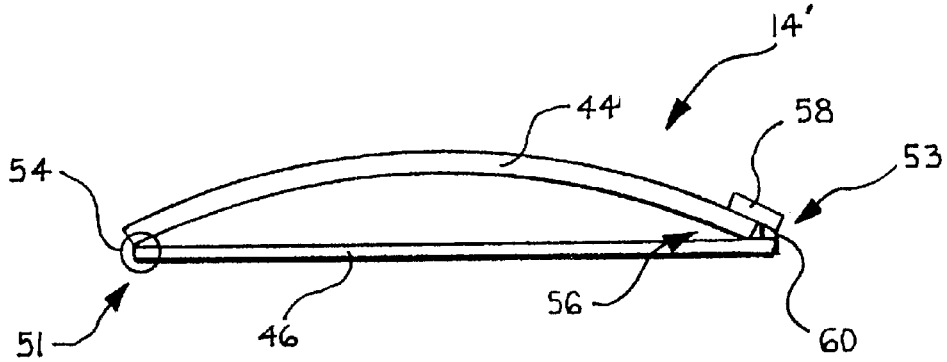
FIG. 9 shows the assembled expanded vane of FIG. 8.

FIGS. 8 and 9 show a laminated opaque portion 14' according to an alternative embodiment of the invention. Similar to the opaque portion 14, the first resilient strip 44 is laminated along one edge to the second narrower strip 46. In addition, one end 51 of the first resilient strip 44 and the second narrower strip 46 are joined together by gluing, welding, stitching, or other attaching means to form the joint 54. However, the opaque portion 14' does not include the attachment means 48 at the other free end 53, but rather includes a receiving pocket 56 made of a narrow strip 58 secured to the second strip 46 by an adhesive 60. The adhesive 60 may be similar to the adhesive 48. To fabricate the opaque portion 14' for use in the composite vane 12, the first resilient strip 44 is bowed to draw the second strip tight across its width until the free end 53 of the first resilient strip 44 is received in the receiving pocket 56. The interior of the first and second strips 44, 46 of the opaque portion 14' of the composite vane 12 forms a torque tube, as shown in FIG. 9.

It will be appreciated that the opaque portions 14, 14' will easily roll for storage prior to fabrication, but will form a torque tube when assembled to maintain the straightness and torsional stiffness of the opaque portions 14, 14' of the composite vane 12, unlike conventional vanes.

Figure 10:
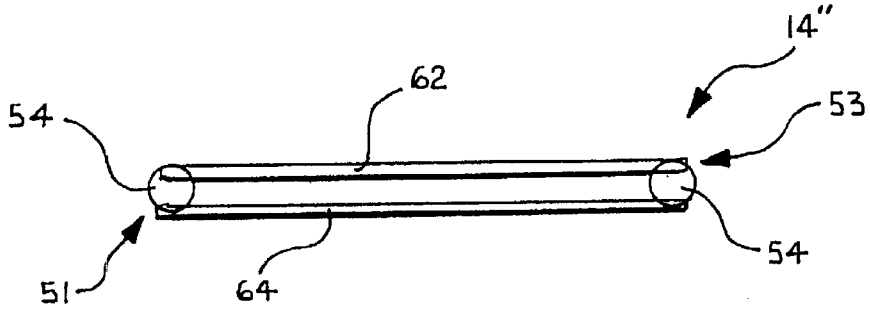
FIGS. 10–12 show another embodiment of a laminated opaque portion for use in the composite vane of the present invention.
Figure 11:
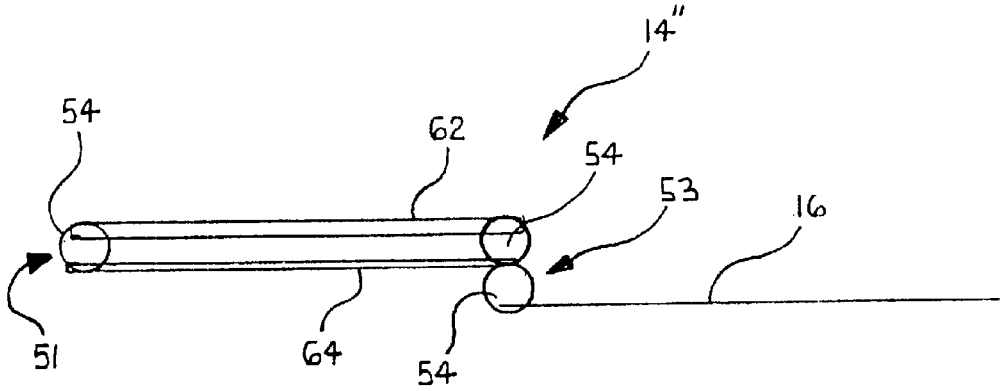
Figure 12:
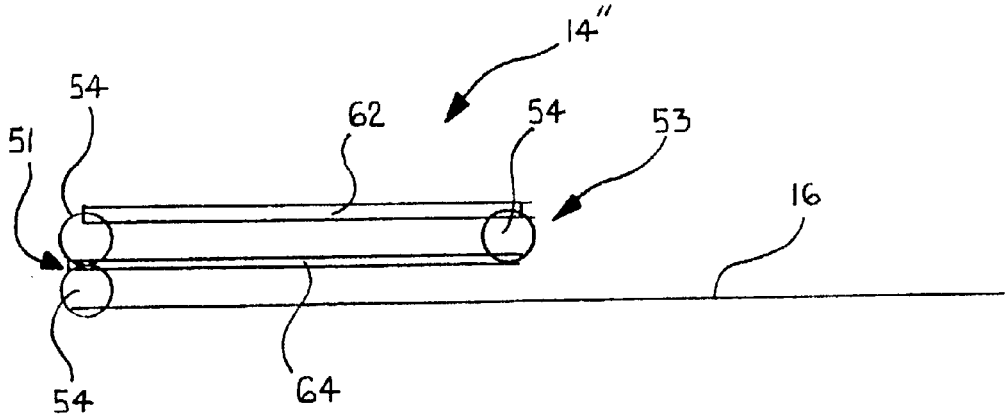

FIGS. 10–12 show another embodiment of a laminated opaque portion 14" for use in the composite vane 12 of the present invention. In this embodiment, the opaque portion 14" of the composite vane 12 includes a first strip 62 and a second strip 64 having substantially the same width as the first strip 62, unlike the earlier opaque portions 14, 14'. The strips 62, 64 may be made of flaccid or resilient material and may have a different thickness. For example, the first strip 62 and/or the second strip 64 may be made of color fabric, or the like. Both edges or free ends 51, 53 of the two strips 62, 64 are joined together by gluing, welding, stitching, or other attaching means to form the joints 54.

As shown in FIG. 10, the sheer portion 16 could be omitted in the composite vane 12 using the opaque portion 14". However, the sheer portion 16 could be included in the composite vane 12 by attaching the sheer portion 16 at one edge 53 of the opaque portion 14", as shown in FIG. 11. The sheer portion 16 could also be included in the composite vane 12 by attaching the sheer portion 16 at the other edge 51, as shown in FIG. 12. In all configurations of FIGS. 10 through 12, the composite vane 12 incorporating the opaque portion 14" can be easily rolled during manufacture and transport.

Figure 13:
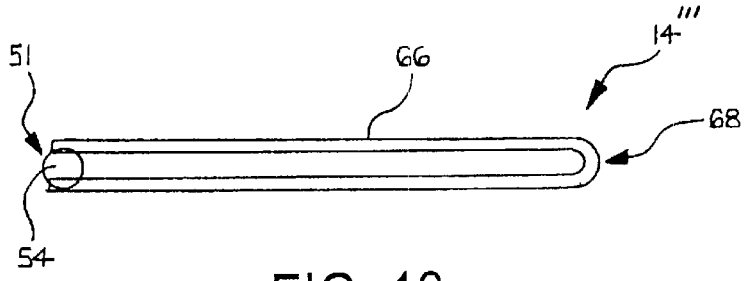
FIGS. 13–15 show an alternate embodiment to the laminated opaque portion for use in the composite vane of the present invention.
Figure 14:
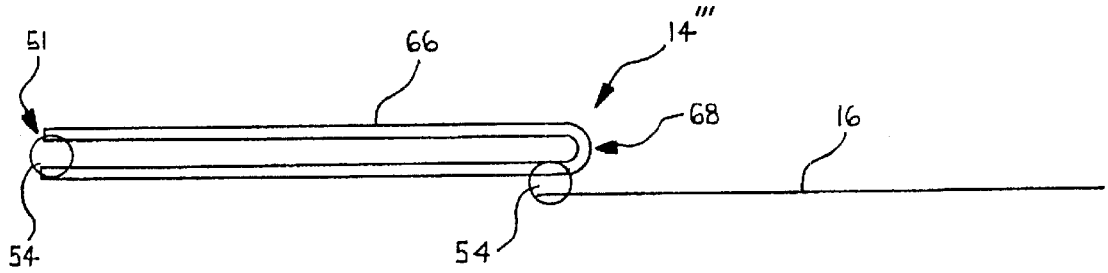
Figure 15:
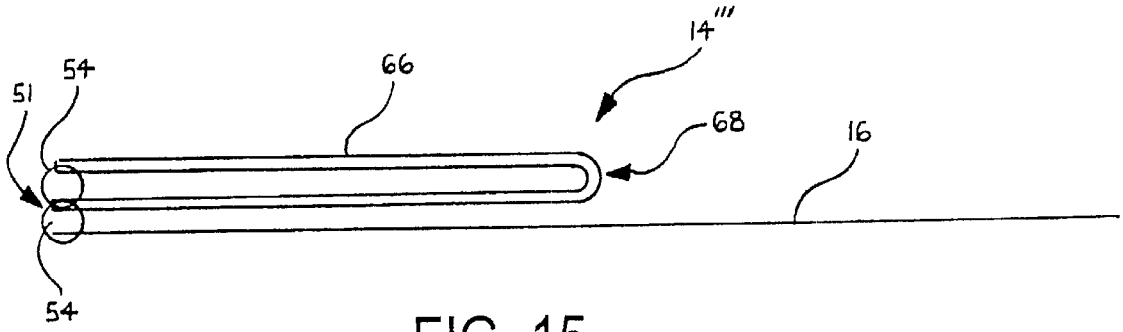

FIGS. 13–15 show an alternate embodiment to a laminated opaque portion 14'" for use in the composite vane 12 in the present invention. In the alternative embodiment, the opaque portion 14'" is formed of a generally U-shaped single strip 66 made of flaccid or resilient material having only one free edge or free end 51. The single strip 66 may be made of color fabric, or the like. The free edge 51 of the opaque portion 14'" is joined together by gluing, welding, stitching, or other attaching means to form the joint 54.

Similar to the opaque portion 14", the sheer portion 16 can be omitted in the composite vane 12 using the opaque portion 14'", as shown in FIG. 13. However, the sheer portion 16 could be included in the composite vane 12 by attaching the sheer portion 16 at an end 68 of the opaque portion 14'", as shown in FIG. 14. The sheer portion 16 could also be included in the composite vane 12 by attaching the sheer portion 16 at the free end 51, as shown in FIG. 15. In all configurations of FIGS. 13 through 15, the composite vane 12 incorporating the opaque portion 14'" can be easily rolled during manufacture and transport.

Figure 16:
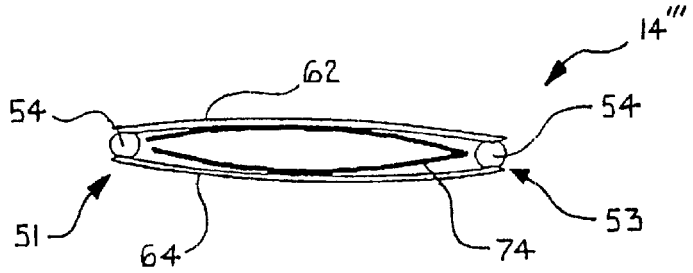
FIG. 16 shows the rollable laminate of FIG. 10, but including a resilient strip or insert formed into a "V" cross-sectional shape.
Figure 17:
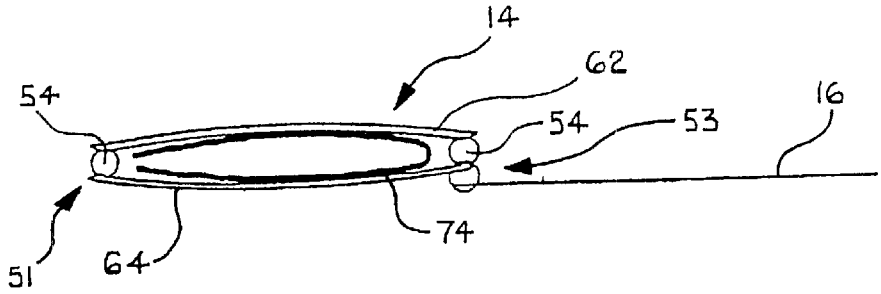
FIG. 17 shows the rollable laminate of FIG. 11, but including a resilient strip or insert formed into a "C" cross-sectional shape.
Figure 18:
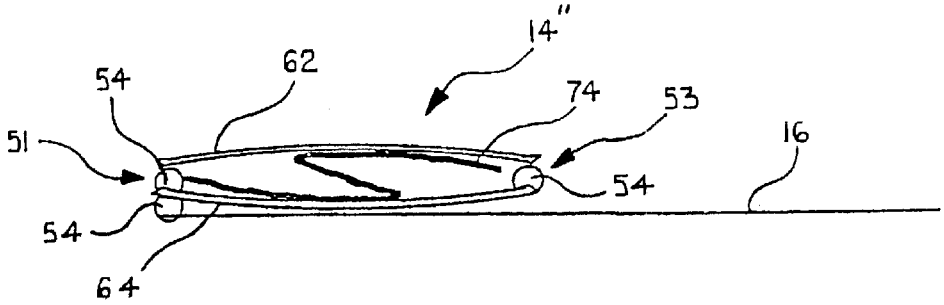
FIG. 18 shows the rollable laminate of FIG. 12, but including a resilient strip or insert formed into an "S" cross-sectional shape.

Referring now to FIGS. 16–18, another aspect of the invention is that the opaque portion for the composite vane 12 may include a resilient insert strip or element 74 that is inserted into the torque tube formed by the laminated opaque portion for maintaining the straightness and torsional stiffness of the opaque portion 14. For illustrative purposes, the strip 74 is shown inserted into the torque tube formed by the laminated opaque portion 14". However, it will be appreciated that the strip 74 can be inserted into any of the previously mentioned alternative embodiments of the laminated opaque portion 14, 14' and 14'". In addition, the illustrative embodiment shown in FIGS. 16–18 shows the resilient strip 74 formed into a "V", "C", "S" cross-sectional shape, respectively. However, it will be appreciated that the resilient strip 74 could be any suitable non-flat cross-sectional shape that could maintain the straightness and torsional stiffness of the torque tube.

Preferably, the resilient strip 74 has substantially the same overall length as the laminated opaque portion 14'". The resilient strip 74 can be inserted between the two strips 62, 64 after the two strips 62, 64 are assembled. However, it is possible to assemble the laminated opaque portion 13" over the resilient strip 74 and be able to roll the blind 10 (especially the "C" and "S" cross-sectional form), provided the resilience of the material forming the strip 74 is sufficient to cause the resilient strip 74 to assume its expanded, straight form when unrolled.

Figure 19:
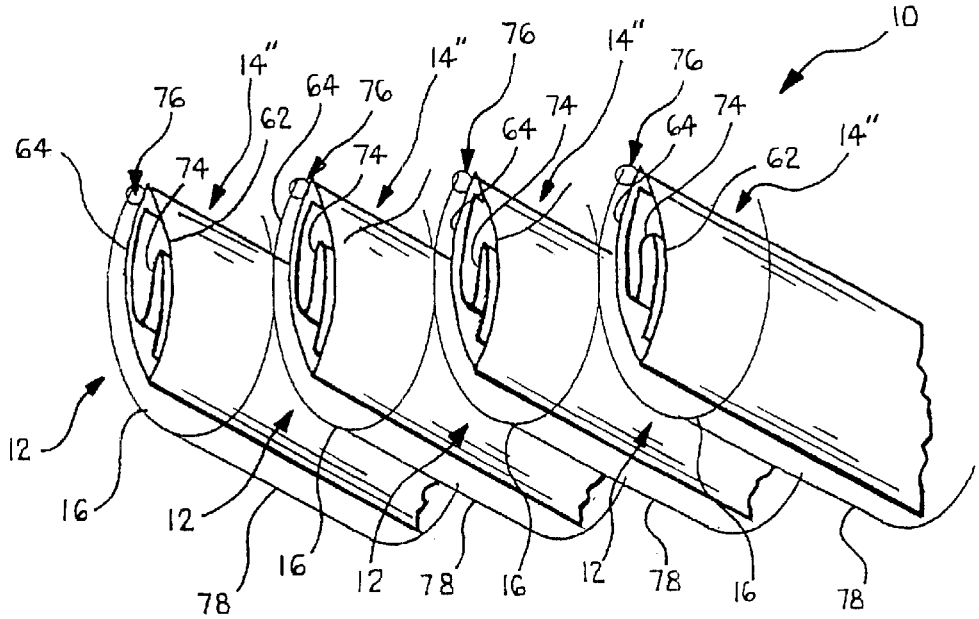
FIG. 19 shows a cutaway perspective view of the assembled vertical blind of FIG. 18 with the sheer attached to the distal edge of the vane.
Figure 20:
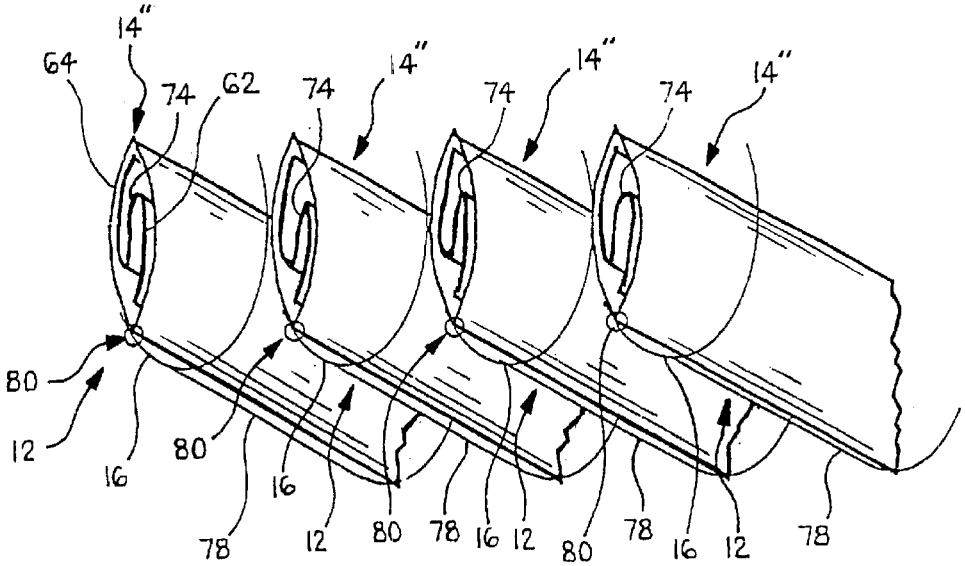
FIG. 20 shows a cutaway perspective view of the vertical blind of FIG. 18 with the sheer attached to the proximal edge of the vane.

When the composite vane 12 includes a sheer portion 16, and particularly when the sheer portion 16 is attached to the adjacent hanger 20 in a top-actuated vertical blind 10 (for example, as shown in FIG. 1), the appearance and function of the blind 10 is affected by an attachment location of the sheer portion 16 with respect to the opaque portion 14", for example, of the laminated composite vane 12. In particular, if the sheer portion 16 is attached along an edge 76 of the opaque portion 14" more distant from the billowed sheer face 78 of the blind 10, then the sheer portions 16 tend to lie in contact with one another and enhance the illusion of a "continuous" sheet, as shown in FIG. 19. If the sheer portion 16 is attached at the edge 80 of the opaque portion 14" nearer the billowed sheer face 78 of the blind 10, then the appearance of that nearer edge 80 effectively vanishes from sight as a separate element, as shown in FIG. 20. As this is largely an aesthetic distinction, either is a preferred embodiment. It is also clear that attachment of the sheer portion 16, if any, at other locations of the opaque portion 14" can be practiced within the scope of the present invention, with varied appearances resulting from these different locations.

Even if the composite vane 12 omits the sheer portion 16 (FIGS. 10, 13 and 16), a composite vane 12 can result that can be attached to a conventional vertical blind head rail and hangers to produce a product very similar to conventional vertical blinds, except with added features. These include:

1) Greatly reduced weight of vanes, as the straightness comes from the novel construction rather than the mass of the vane or added weights at their bottom ends. Weight reduction reduces operating forces and wear on the hangers.
2) Improved closure when the vanes are rotated into contact for light-blockage, due to the superior straightness and stiffness of the torque-tube vanes;
3) Improved thermal insulation, due to the trapped air in the torque tube. Insulation can be further enhanced by including a light foam or fiber backing on the insert to reduce vertical air movement;

4) Selectable levels of light-control by changing the insert properties within a common, color-matched exterior finish. This feature might be useful as a seasonal change where sunlight is a problem in summer, but desirable in winter;

5) Aesthetic improvements in the airfoil shape of the vane and the superior straightness achievable with the new construction;

6) Easier installation, due to the lightweight of the vanes;

7) Washability of the vanes, which can be separated from their inserts and from the rest of the elements comprising the blind assembly, as needed for cleaning.

All of these advantages also apply to the sheer-attached versions shown in FIGS. 11, 12, 14, 15, 17 and 18, which in addition, have:

1) Added privacy from sheer covering in view-through mode;

2) Unique washability for a sheer-vertical, as all others known have a continuous sheer sheet (some with permanently attached vanes), not smaller manageable strips.

The novel vane construction of the present invention can be applied to a horizontal blind as well as a vertical blind. In this application, the stiffness and low mass of the vane are key benefits, allowing for instance, increased spacings between ladder cord supports, though the torsional stiffness also prevents warping common to solid or flat-vane venetian blinds (typically, wood, vinyl, or aluminum). Most of the advantages in light-control variations and insulation apply as well to horizontal applications, though conventional horizontal actuation assemblies may prevent removal of individual vanes for cleaning.

Figure 21:
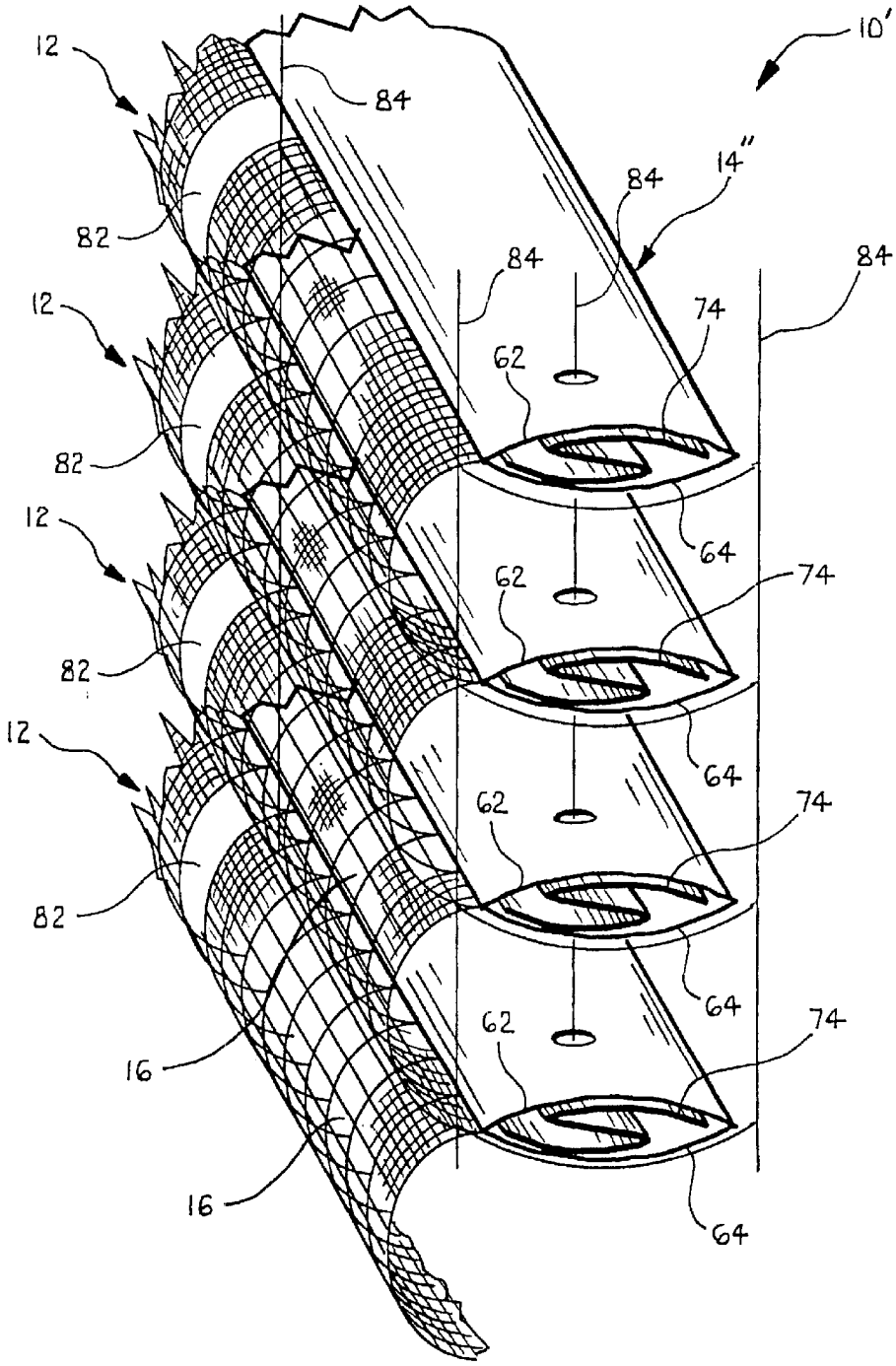
FIG. 21 shows a cutaway perspective view of a ladder-supported sheer-faced horizontal blind including a vane with the resilient strip formed in an "S" cross-sectional shape.
Figure 22:
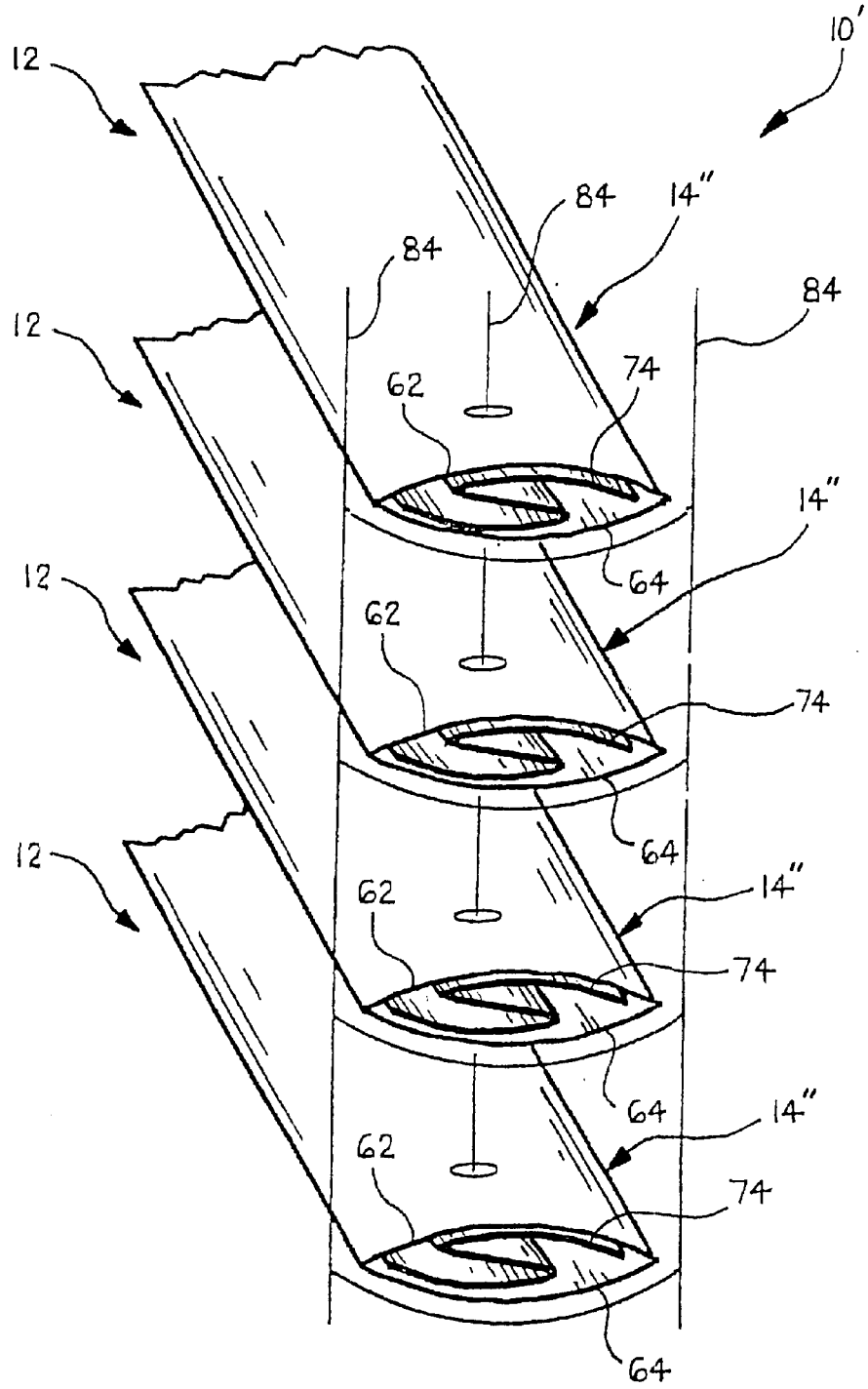
FIG. 22 shows a cutaway perspective view of a ladder-supported horizontal blind of FIG. 7, but without the sheer.

In a conventional ladder-cord assembly of a horizontal blind, the composite vane 12 of the invention can be used with or without sheer portion 16 (FIGS. 21 and 22, respectively). However, if the composite vane 12 includes the sheer portion 16, the sheer portion 16 must include a slit 82 to pass a ladder cord 84. In this configuration, the operation is exactly like that of a conventional venetian blind. In particular, the ladder-cord assembly 10' of the invention can be retracted from the window (not shown) by drawing the composite vanes 12 of the invention into a stack.

When the vanes 12 are stacked, a great advantage of the new composite vanes 12 of the invention is revealed. With conventional large-format venetian blinds (2 and 2.5 inch widths are currently popular), the thickness of the vanes, especially in wood or plastic is significant (typically 0.06 to 0. 15 inch thickness per vane). When these are pulled into a stack, the total height of the stack, equal to the sum of the vane thickness, can be a large part of the entire window height. With the composite vane 12 of the present invention, the individual vanes can have a thickness similar to conventional vanes when arrayed across the window, but the insert strip 74 easily allows the composite vane 12 to be collapsed further when pressed together in a stack between the head rail 18 and a bottom rail (not shown). Typical collapsed vane thickness of 0.03 inches is easily possible, giving a stack as much as 80% less than comparable rigid-vane venetian blinds (and approaching the compactness of the best, cellular shades). The lightweight stiffness of the new composite vanes 12 of the invention may also allow wider spacing of ladder cords for lower cost and improved aesthetics. Further, the improved composite vane 12 allows for large-format venetian blinds has several advantages as follows:

1) Lower total mass as compared to wood, metal or plastic solid vanes;

2) Extended spacing between supports because of an improved stiffness-to-weight ratio;

3) Tremendously smaller stacked height;

4) Light-diffusing options;

5) Fabric or printed finishes; and

6) Aesthetically-pleasing substantial thickness in the composite vanes when deployed.

Figure 23:
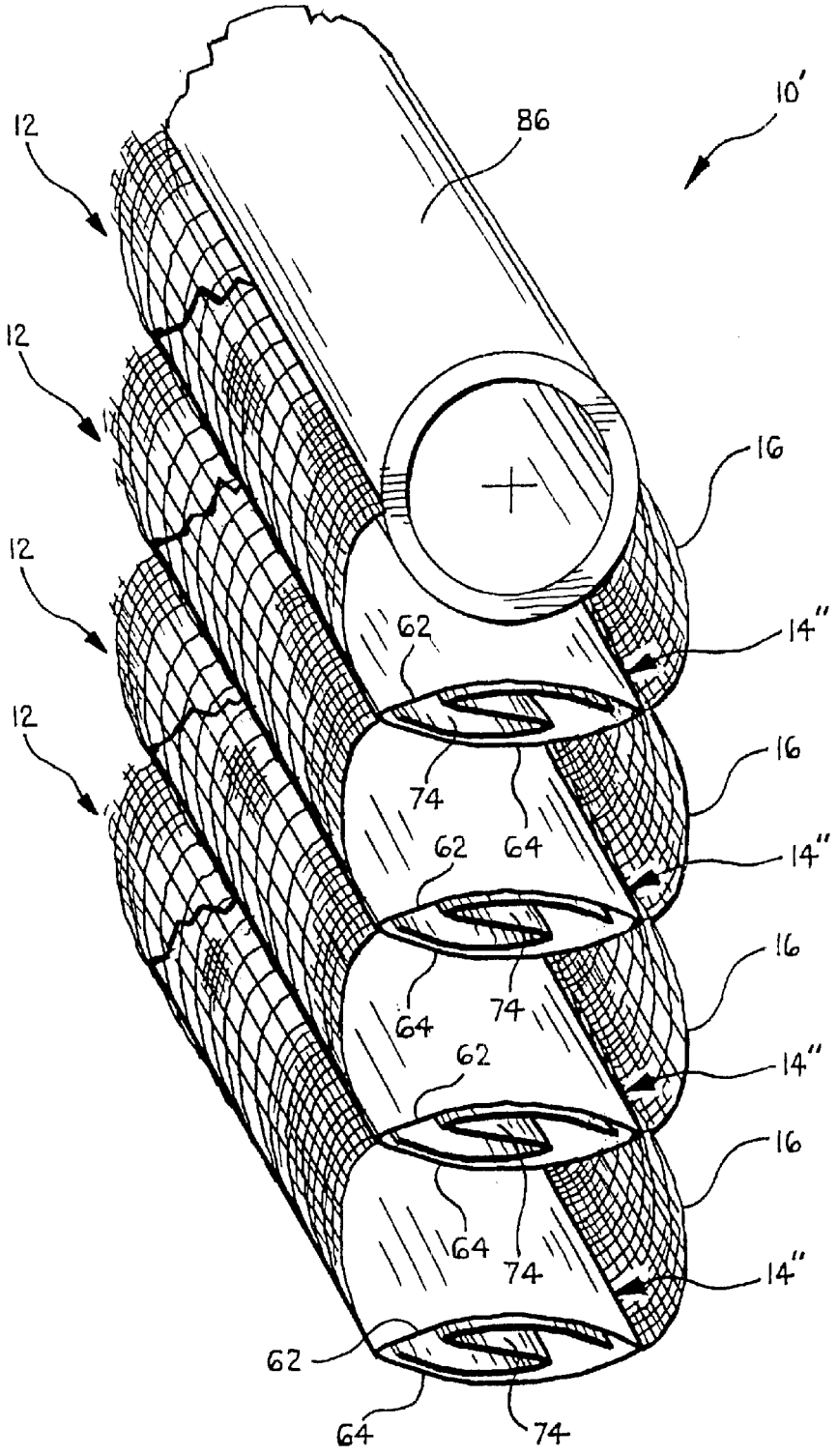
FIG. 23 shows a sheer-supported horizontal blind including a vane with the resilient strip formed in an "S" cross-sectional shape.

Referring now to FIG. 23, an alternate embodiment of the ladder-cord assembly 10' is illustrated. In this embodiment, the sheer portion 16 is included in the laminated opaque portion 14" and extends from both edges of the opaque portion 14". The illustrated embodiment including the composite vanes 12 with the insert strips 74 of the invention is an improvement over conventional fabric venetian blinds that include vanes with only flat flaps of fabric. In addition, the alternative embodiment provides insulation when closed, superior closure, and a more pleasing undulating surface when closed, as compared to conventional blinds having flat flaps of fabric. Further, the resilience of the insert strip 74 allows the composite vane 12 to flatten and roll (now in a transverse curling) around a roller 86 that is typically used in fabric venetian blinds instead of stacking (as with rigid venetian blinds).

It will be appreciated that the composite vane 12 can be manufactured by using a wide variety of techniques. For example, the composite vane 12 can be made of single piece of extrudable material, such as MYLAR® and the like, that can be extruded to form the torque tube of the invention. The composite vane 12 formed of MYLAR® material can have a wall thickness in the range of between about 0.003 to 0.010 inches for a composite vane 12 having a width of about 3 to 4 inches. It will be appreciated that the wall thickness of the composite vane 12 is roughly proportional to the width. Thus, the wall thickness can be thinner for a composite vane having less width, and vice versa.

One advantage of the composite vane 12 formed by extruding a single piece of material is that the composite vane 12 does not include the bond lines 54 as in the previous embodiments. In addition, the combination of the torque tube having a football-shaped cross section and the thickness of the composite vane 12 allows the composite vane 12 to have the torsional stiffness for enabling the composite vane 12 to maintain its cross-sectional shape while used as a vertical blind. In addition, the combination of the cross-sectional shape and thickness allows the composite vane 12 to collapse when stacked while used as a horizontal blind and to expand when not stacked.

While the invention has been specifically described in connection with certain specific embodiments thereof, it is to be understood that this is by way of illustration and not of limitation, and the scope of the appended claims should be construed as broadly as the prior art will permit.

What is claimed is:

1. An architectural covering for a window, comprising:

a plurality of vanes, at least one vane comprising a laminated opaque portion including a first strip and a second strip forming a closed-perimeter torque tube therebetween, and a resiliently collapsible insert received within an interior formed between the first and second strips, wherein the first and second strips compress the resiliently collapsible insert to cause a portion of the first and second strips to be spaced apart from each other.

2. The architectural covering according to claim 1, further including a sheer made of individual, narrow strips of sheer material attached to the at least one vane.

3. The architectural covering according to claim 1, wherein said first strip has a different thickness than said second strip.

4. The architectural covering according to claim 1, wherein said resiliently collapsible insert and said first and second strips are of substantially equal length.

5. The architectural covering according to claim 1, wherein the resiliently collapsible insert has a non-flat cross-sectional shape.

6. The architectural covering according to claim 5, wherein the non-flat cross sectional shape comprises one of a C-shaped cross sectional shape, a V-shaped cross sectional shape, and an S-shaped cross sectional shape.

7. The architectural covering according to claim 1, wherein said laminated opaque portion and said resiliently collapsible insert are capable of being rolled flat prior to their integration.

8. An architectural covering for a window, comprising:

a plurality of vanes, at least one vane including a laminated relatively opaque strip comprising first and second elongated and overlapping strips, the first and second strips including first and second longitudinally extending edges, means for selectively attaching one of the first and second longitudinally extending edges of the first strip to one of the first and second longitudinally extending edges of the second strip such that the attached longitudinally extending edges abut each other, and a resiliently collapsible insert received within an interior formed between the first and second strips, wherein the first and second strips compress the resiliently collapsible insert to cause a portion of the first and second strips to be spaced apart from each other.

9. The architectural covering according to claim 8, wherein the vane further includes a sheer portion made of individual, narrow strips of sheer material attached to one of the first and second longitudinally extending edges of the first and second strips.

10. The architectural covering according to claim 8, wherein said first strip has a different thickness than said second strip.

11. The architectural covering according to claim 8, wherein one of said at least one vane and said resiliently collapsible insert are capable of being rolled flat prior to their integration.

12. The architectural covering according to claim 8, wherein said resiliently collapsible insert and said first and second strips are of substantially equal length.

13. The architectural covering according to claim 8, wherein the resiliently collapsible insert has a non-flat cross-sectional shape.

14. The architectural covering according to claim 13, wherein the non-flat cross sectional shape comprises one of a C-shaped cross sectional shape, a V-shaped cross sectional shape, and an S-shaped cross sectional shape.

15. An architectural covering for windows, comprising:

a plurality of vanes, at least one vane comprising an integrated composite of an opaque portion comprising a first strip and a second strip, and an adjacent sheer portion made of individual, narrow strips of sheer material, an upper end of the sheer portion being adapted to be secured to at least one of an adjacent hanger and an adjacent vane, and a resiliently collapsible insert received within an interior formed between the first and second strips, wherein the first and second strips compress the resiliently collapsible insert to cause a portion of the first and second strips to be spaced apart from each other.

16. The architectural covering according to claim 15, wherein the opaque portion of each vane forms a closed-perimeter torque tube.

17. The architectural covering according to claim 15, wherein the resiliently collapsible insert has a non-flat cross-sectional shape.

18. The architectural covering according to claim 17, wherein the non-flat cross sectional shape comprises one of a C-shaped cross sectional shape, a V-shaped cross sectional shape, and an S-shaped cross sectional shape.

19. An architectural covering for a window, comprising:

a plurality of vanes, at least one vane comprising an opaque flaccid tube and a resiliently collapsible insert centrally, received within the tube, whereby the resiliently collapsible insert is compressed in cross section by the tube,and causes the tube to change its cross section to form a torsionally rigid structure.

20. The architectural covering according to claim 19, wherein the resiliently collapsible insert has a non-flat cross sectional shape.

* * * * *

UNITED STATES PATENT AND TRADEMARK OFFICE

CERTIFICATE OF CORRECTION

PATENT NO. : 6,688,373 B2
DATED : February 10, 2004
INVENTOR(S) : John A. Corey et al.

It is certified that error appears in the above-identified patent and that said Letters Patent is hereby corrected as shown below:

Column 12,
Line 37, please delete "," after "centrally"

Signed and Sealed this

First Day of June, 2004

JON W. DUDAS
*Acting Director of the United States Patent and Trademark Office*